US007537085B2

(12) United States Patent
Vetesnik

(10) Patent No.: US 7,537,085 B2
(45) Date of Patent: May 26, 2009

(54) FALL RESTRAINT ANCHORING POST

(75) Inventor: Jan Vetesnik, Winnipeg (CA)

(73) Assignee: Capital Safety Group Winnipeg Ltd., Winnipeg, Manitoba (CA)

( * ) Notice: Subject to any disclaimer, the term of this patent is extended or adjusted under 35 U.S.C. 154(b) by 959 days.

(21) Appl. No.: 10/407,904

(22) Filed: Apr. 7, 2003

(65) Prior Publication Data

US 2004/0195041 A1 Oct. 7, 2004

(51) Int. Cl.
*A62B 35/00* (2006.01)

(52) U.S. Cl. ..... 182/3; 182/45

(58) Field of Classification Search ..... 182/3, 182/45

See application file for complete search history.

(56) References Cited

U.S. PATENT DOCUMENTS 3,978,989 A * 9/1976 Avila, Jr. ..... 212/176
4,241,838 A * 12/1980 Hayes ..... 212/255
4,987,976 A 1/1991 Daugherty
5,413,063 A * 5/1995 King ..... 114/221 R
5,451,228 A * 9/1995 Johnson et al. ..... 606/86
5,634,619 A * 6/1997 Alessi ..... 248/219.3
5,718,305 A 2/1998 Palmer
6,425,727 B1 * 7/2002 Hood ..... 414/543
6,761,094 B2 * 7/2004 Tobako ..... 81/177.2

FOREIGN PATENT DOCUMENTS

CA 2179248 6/1996
DE 19519522 C1 * 11/1996
GB 2377964 1/2003

* cited by examiner

*Primary Examiner*—Alvin C Chin-Shue
(74) *Attorney, Agent, or Firm*—IPLM Group, P.A.

(57) ABSTRACT

An apparatus for use in fall restraint anchoring of workers on an elevated location includes an upstanding post with at least one attachment loop at an upper end. The post is formed by plurality of coaxial cylindrical tubes each mounted as a sliding fit inside the next with each insert tube having a longitudinal groove co-operating with a projecting set screw on the outer tube so as to prevent relative rotation and to locate the limits of movement for aligning holes in the tubes for a locking pin. A jib portion includes a collar located on the smallest tube with a lower edge sitting on the upper edge of the next tube and extends upwardly and outwardly to a tether which extends to the attachment loop.

16 Claims, 4 Drawing Sheets

FALL RESTRAINT ANCHORING POST

BACKGROUND OF THE INVENTION

This invention relates to a fall restraint anchoring post for use in attachment thereto of fall restraints for one or more persons working at a raised elevation on a location where the post is mounted.

In Canadian Application 2,179,248 published Dec. 18, 1997 is disclosed a fall restraint anchoring system which can be used at an elevated location such as the top of a transformer where one or more workers is required to be tethered to an upstanding post by a harness and line to prevent accidental fall from the elevated location.

Such harnesses together with the necessary line, pay-out system and shock absorption system are well known and are commercially available. Posts of the type generally shown in the above patent application have been commercially available for many years and are widely used. The post has at its upper end three rings which rotate around the longitudinal axis of the post and each carries a loop which can be attached to a respective one of the three workers individually attached to the post. Workers therefor can move around the post to the required location for there current function but if any one or all of the workers fall from the elevated location, they are supported by the posts, falling only a short distance before the line and harness halt there fall. The elevation of the post reduces the distance that the worker falls.

It is often desirable that the post be collapsible from a retracted condition to the required extended condition for operation so that it can be transported and stored readily in the retracted condition. For this purpose the post is manufactured from square tubing with each portion slidable inside the next. This provides a relatively crude construction using relatively expensive square tubing.

Further examples of devices of this general type are shown in U.S. Pat. No. 4,987,976 (Daugherty) assigned to Vermette Machine Company and issued Jan. 29, 1991 and in U.S. Pat. No. 5,718,305 (Palmer) issued Feb. 17, 1998.

SUMMARY OF THE INVENTION

It is one object of the invention to provide an improved post construction which can be used to attach one or more workers as a fall restraint anchoring system.

According to one aspect of the invention there is provided an apparatus for use in fall restraint anchoring comprising:

a base member for mounting at a location where workers require to be restrained against falling;

a post having a bottom mounting for attachment to the base member such that the post is supported in upstanding arrangement from the base member at the location;

at least one attachment loop at an upper end of the post for connection to a fall restraint connection line of a worker;

the post comprising a plurality of coaxial cylindrical tubes, each of circular cross-section, including a outer tube and an insert tube mounted as a sliding fit inside the outer tube for sliding movement longitudinally thereof for movement from an extended operating position to a retracted position, either the outer tube or the insert tube being attached to the bottom mounting;

the outside surface of the insert tube having a groove formed longitudinally thereof extending only part way therealong so that the groove terminates at its upper end a position spaced from an upper end of the insert tube and so that the groove terminates at its lower end a position spaced from a lower end of the insert tube;

and the outer tube having a projecting element at a fixed position thereon extending radially inwardly of the inside surface thereof so as to extend into the groove;

the groove and the projecting element being arranged and located so as to limit movement of the insert tube relative to the outer tube so that the tubes are prevented from relative rotational movement and so that the insert tube is limited to movement only between said extended and retracted positions.

Preferably the projecting element comprises a set screw.

Preferably there is only a single groove and a single projecting element.

Preferably the outer tube and the insert tube have holes therethrough arranged to be aligned in the extended position for receipt therethrough of a locking pin and wherein the groove and the projecting element are arranged so that the holes are properly aligned for receipt of the pin when the projecting element reaches the end of the groove.

Preferably there is provided a clamping screw mounted on the outer tube so as to move a clamping end thereof radially of the outer tube and operable to clamp against the outer surface of the insert tube.

Preferably the clamping screw is arranged on the outer tube at a position spaced 180 degrees angularly from the projecting element.

Preferably the post includes a plurality of attachment loops at axially spaced positions on the post each arranged for rotation around the post about the axis of the post.

Preferably there is provided a separate extension piece arranged to be mounted on an upper end of the post and extending upwardly therefrom and including a further attachment loop at its upper end.

Preferably there is provided a second insert tube mounted as a sliding fit inside the insert tube for sliding movement longitudinally thereof for movement from an extended operating position to a retracted position; the outside surface of the second insert tube having a second groove formed longitudinally thereof extending only part way therealong so that the second groove terminates at its upper end a position spaced from an upper end of the second insert tube and so that the second groove terminates at its lower end a position spaced from a lower end of the second insert tube; and the insert tube having a second projecting element at a fixed position thereon extending radially inwardly of the inside surface thereof so as to extend into the second groove; the second groove and the second projecting element being arranged and located so as to limit movement of the second insert tube relative to the insert tube so that the tubes are prevented from relative rotational movement and so that the second insert tube is limited to movement only between said extended and retracted positions.

Preferably the second groove is arranged at 180 degree angular spacing from the groove.

Preferably there is provided a jib portion comprising:

a collar surrounding the upper insert tube and mounted thereon as a sliding fit so as to be rotatable thereon about the axis of the post;

the collar having a bottom abutment surface resting upon a top edge of the lower outer tube a jib member mounted on the collar so as to extend outwardly from the collar to one side of the post;

the jib member being mounted on the collar for upward and downward pivotal movement about a horizontal axis;

and a tether member extending from the jib member to the attachment loop for supporting the jib member at an angle inclined upwardly and outwardly from the collar.

Preferably the collar includes two semi-cylindrical collar parts connected by a hinge on one side of the post and clamped at abutment surfaces on an opposed side of the post.

Preferably the jib member includes at least one bracket for supporting a winch and a pulley at an outer end thereof over which a cable from the winch is guided to pass.

Preferably the post includes a bottom tube, an uppermost tube and at least one intermediate tube all of which are slidable each into the next and wherein the collar is clamped onto the uppermost tube with its abutment surface resting against an upper edge of the intermediate tube.

According to a second aspect of the invention there is provided an apparatus for use in fall restraint anchoring comprising:

a base member for mounting at a location where workers require to be restrained against failing;

a post having a bottom mounting for attachment to the base member such that the post is supported in upstanding arrangement from the base member at the location;

at least one attachment loop at an upper end of the post for connection to a fall restraint connection line of a worker;

the post comprising a plurality of coaxial cylindrical tubes, each of circular cross-section, including a lower outer tube and an upper insert tube mounted as a sliding fit inside the lower outer tube for sliding movement longitudinally thereof for movement from an upwardly extended position to a lower retracted position;

and a jib portion comprising:

a collar surrounding the upper insert tube and mounted thereon as a sliding fit so as to be rotatable thereon about the axis of the post;

the collar having a bottom abutment surface resting upon a top edge of the lower outer tube a jib member mounted on the collar so as to extend outwardly from the collar to one side of the post;

the jib member being mounted on the collar for upward and downward pivotal movement about a horizontal axis;

and a tether member extending from the jib member to the attachment loop for supporting the jib member at an angle inclined upwardly and outwardly from the collar.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figure 1:
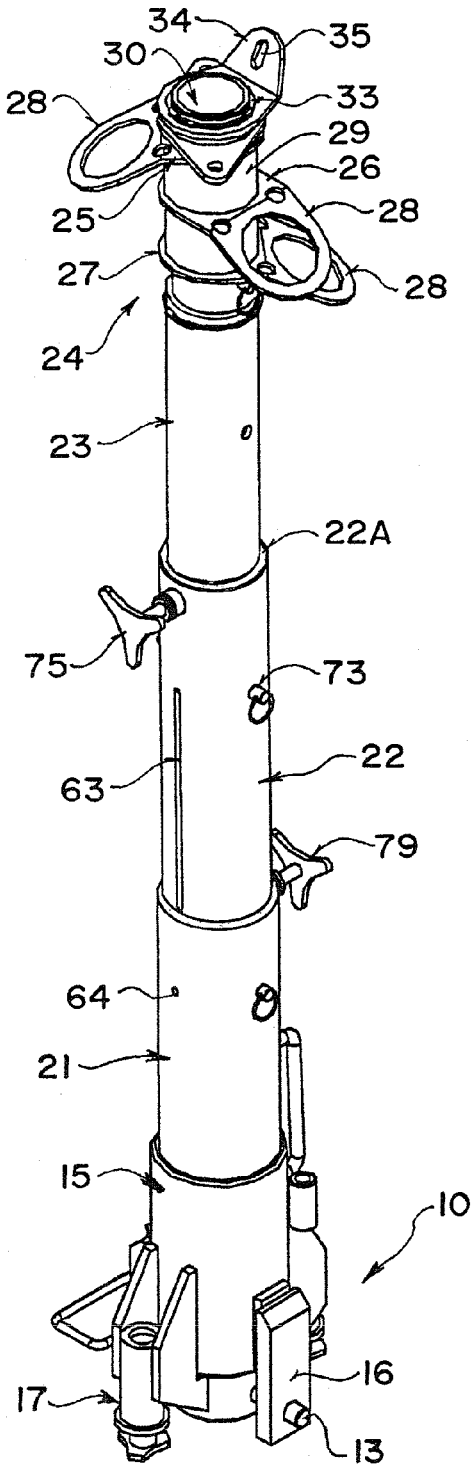
FIG. 1 is an isometric view from above and one side of a post assembly according to the present invention.
Figure 2:
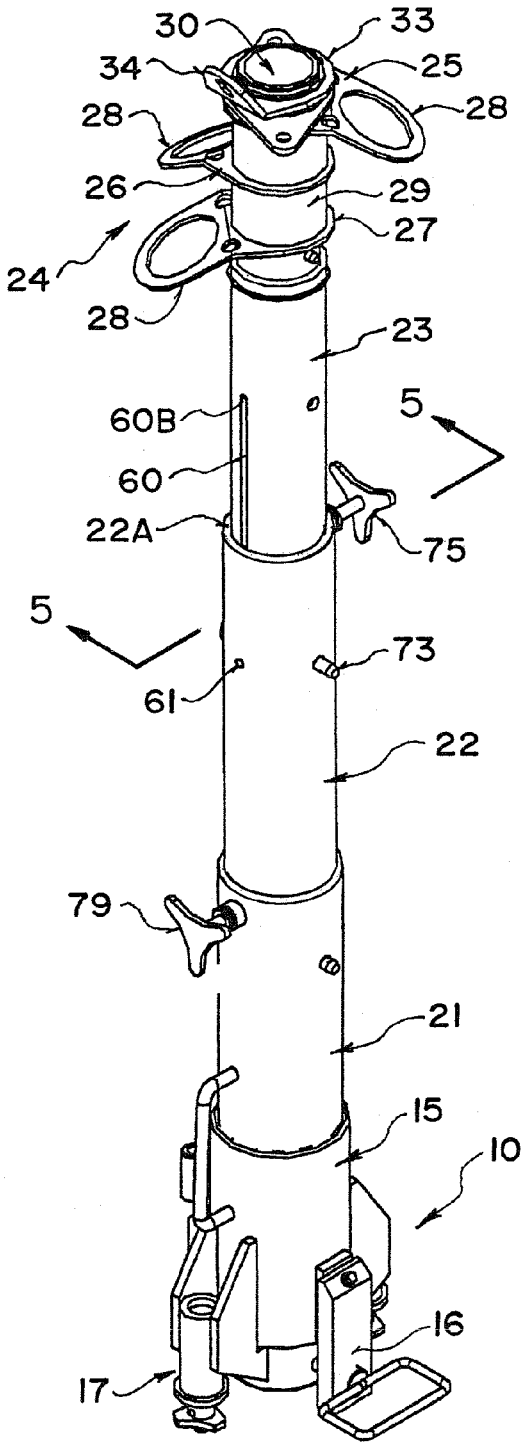
FIG. 2 is an isometric view from above and the opposite side of the post assembly of FIG. 1.
Figure 3:
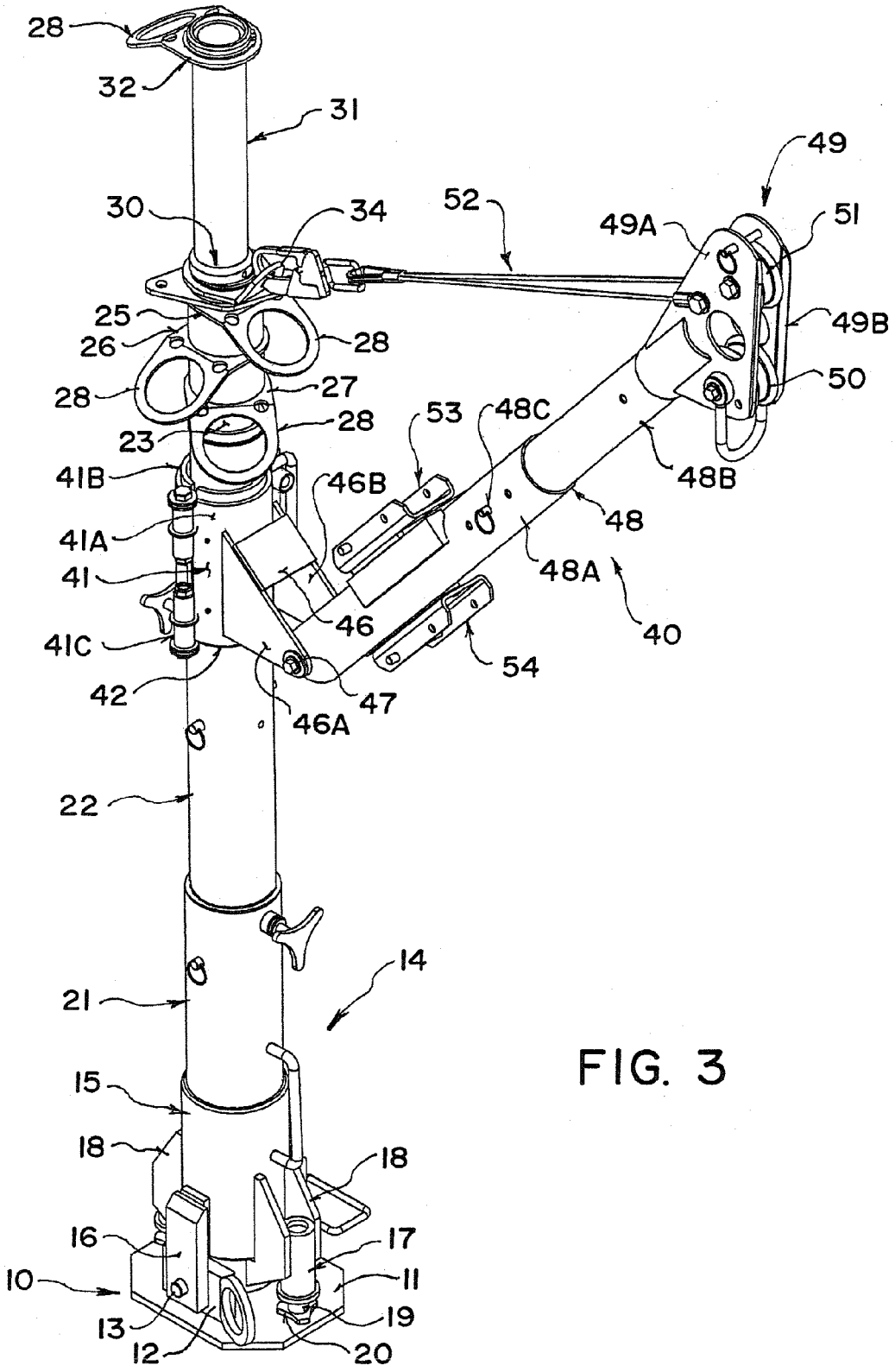
FIG. 3 is an isometric view of the post assembly of FIG. 1 including a jib portion mounted thereon.

The complete anchoring post system is shown in FIG. 3 and comprises a base member 10 arranged for attachment to a top surface of an elevated support structure such as a transformer where workers are required to carry out various functions and must be protected against the dangers of falling. The base member 10 comprises a base plate 11 with a pair of upstanding lugs 12 which define a support for a pivot pin 13 to which the post 14 can be attached for pivotal movement about a horizontal axis parallel to and spaced upwardly from the plate 11. The post 14 comprises a base portion 15 which has two lugs 16 extending downwardly therefrom before co-operation with the lugs 12 and receiving the pin 13 the base portion 15 further includes two levelling screws 17 each on a respective side and at 90 degrees from the lugs 16. The levelling screws 17 are mounted on brackets 18 welded to the side of the base portion 15 and carry a cylindrical sleeve into which is screwed a jack 19 having a base plate 20. Rotation of the screw jack 19 and the base plate 20 acts to press the base plate against the upper surface of the plate 11 thus levelling the post by rotation about the axis of the pin 13.

The post 14 is formed from a plurality of tubular portions each of circular cross section. The tubular portions include the base portion 15, a bottom tubular portion 21, a first insert tubular portion 22 and a second insert tubular portion 23.

Each of the tubular portions is of slightly less diameter than the next so that each is inserted as a sliding fit into the next. The base portion 15 is fixed to or welded to the bottom tubular portion 21 so that this is fixed and provides a stanchion for the remaining tubular portions 22 and 23.

At the top of the uppermost tubular portion 23 is provided a mounting section generally indicated at 24 which includes three rings 25, 26 and 27 each of which has respective attachment loop 28 and each of which is mounted for rotation about the vertical axis of the post. Thus each ring has a planar portion mounted on the post in a radial plane of the post with each ring being separated from the next by a slide collar 29 holding the rings at axially spaced positions and allowing each ring to rotate around the post independently of the others. Each attachment loop is carried on the ring and is inclined downwardly and outwardly from the radial plane of the plate portion of the ring to form an attachment to which a suitable tethering hook can be attached for the harness of the worker concerned.

At the top of the mounting section 24 is provided an open mouth 30 of the top section of the post into which can be inserted an insert piece 31 in the form of a short length of post carrying an additional ring 32 similar to the rings 25, 26 and 27. At the top of the top portion of the post at the mouth 30 is provided an additional ring 33 which also can rotate around the axis of the post and provides an upturned flange 34 having a hole 35.

Figure 4:
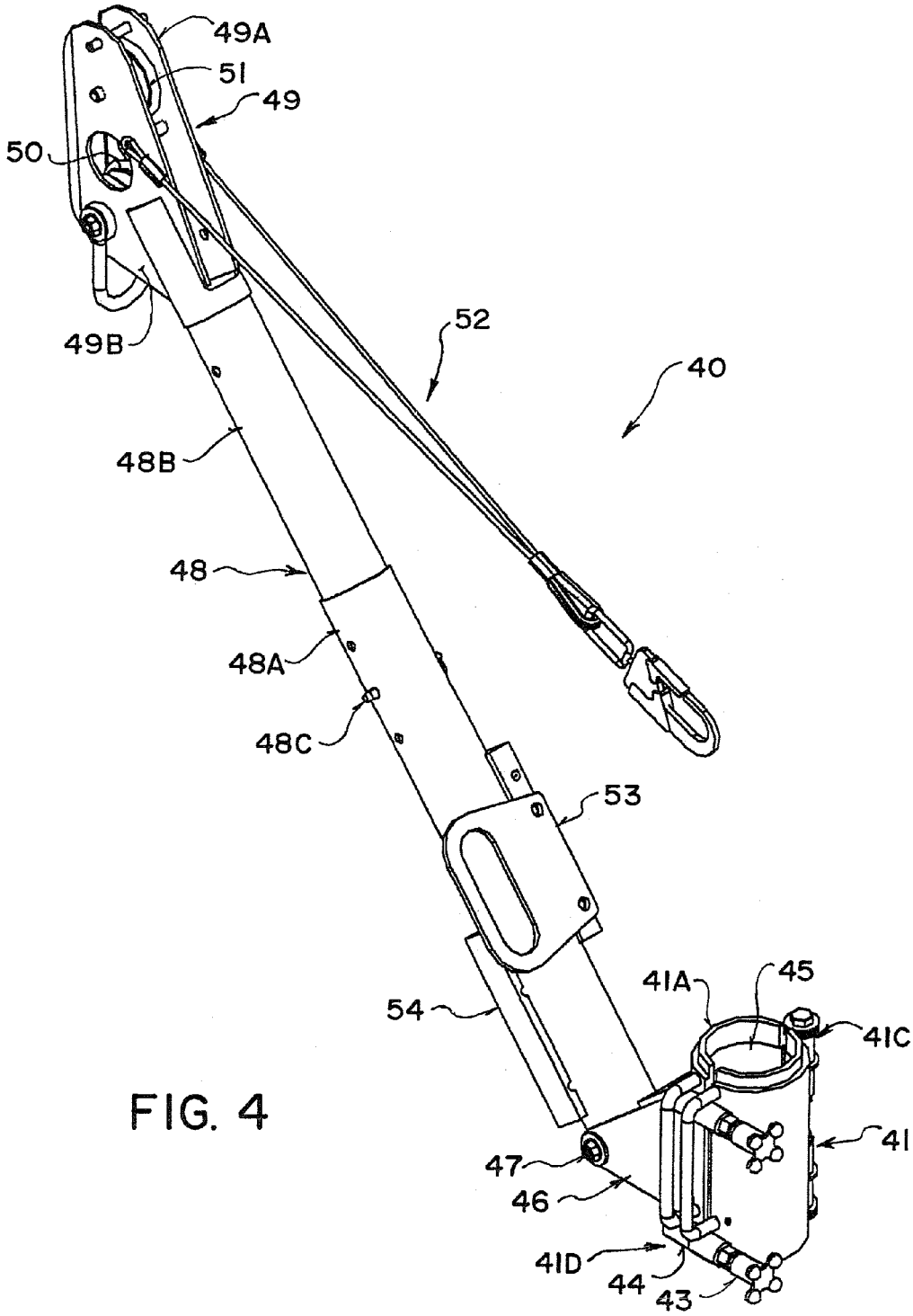
FIG. 4 is an isometric view of the jib portion of FIG. 3 from the opposite side.

Onto the top section 23 of the post is mounted a jib portion generally indicated at 40 which includes a collar 41 surrounding the top portion 23 with the bottom edge 42 of the collar sitting on an upper edge 22A of the tubular portion 22. The collar 41 is formed in two semi-cylindrical portions 41A and 41B connected by a hinge 41C. The hinge 41C defines a vertical axis along side the upper portion 23 of the post. As shown in FIG. 4, on the opposite side to the hinge 41C is provided a clamping section 41D clamping together the to halves 41A and 41B. The clamping section includes two screws 43 which are threaded so as to engage into nuts 44 to clamp together the two sections at an abutting edge therebetween. Thus the clamped collar has diameter of its inside surface slightly greater than the outside surface of the upper tubular portion 23 so as to provide a sliding fit thereon allowing rotation of the collar on the tubular portion 23. A plastics bearing sleeve 45 is provided on the inside surface of the collar to surround the tubular portion 23 to allow ready rotation of the collar on the tubular portion.

The collar 41 carries a bracket 46 on one side, the bracket being formed by two flanges 46A and 46B which project outwardly to this side to carry a pivot pin 47 which has a horizontal pivot axis spaced outwardly from one side of the post. Onto the pin 47 is mounted a jib member 48 of the jib portion. Jib member 48 is formed from two tubular portions 48A and 48B which slide one inside the other to a position locked by a transverse pin 48C. At the outer end of the jib member 48 is provided a pulley mount 49 defined by two parallel flanges 49A and 49B supporting between them a pair of pulleys 50 and 51. The jib member 48 can thus pivot about the pin 47 and is maintained in an upwardly and outwardly inclined orientation by a tether 52 which extends from the end portion 49 to the flange 34 of the ring 33. As the ring 33 and the collar 41 can both rotate around the post, the jib portion can be moved to any required angular orientation. The lower tubular portion 48A of the jib member 48 carries a pair of brackets 53 and 54 each for mounting a respective winch for providing a cable for passing over a respective one of the pulleys 50 and 51 to allow the jib portion to act as a lifting mechanism for example for raising and lowering a worker tethered to the post.

Each of the tube portions 22 and 23 is thus slidable inside its next adjacent partner. Thus the tube portion 22 can slide inside the tube portion 21 and the tube portion 23 can slide inside the tube portion 22. However the tube portions are guided to limit the amount of axial or longitudinal movement allowed between the portions and also to prevent rotational movement between the two portions. This guiding action is provided by a slot or groove 60 provided in the tubular portion 23 which co-operates with a projectional set screw 61 provided in the tubular portion 22.

A symmetrical second groove 63 is provided in the tubular portion 22 which co-operates with a second set screw 64 provided in the tubular portion 21.

Figure 5:
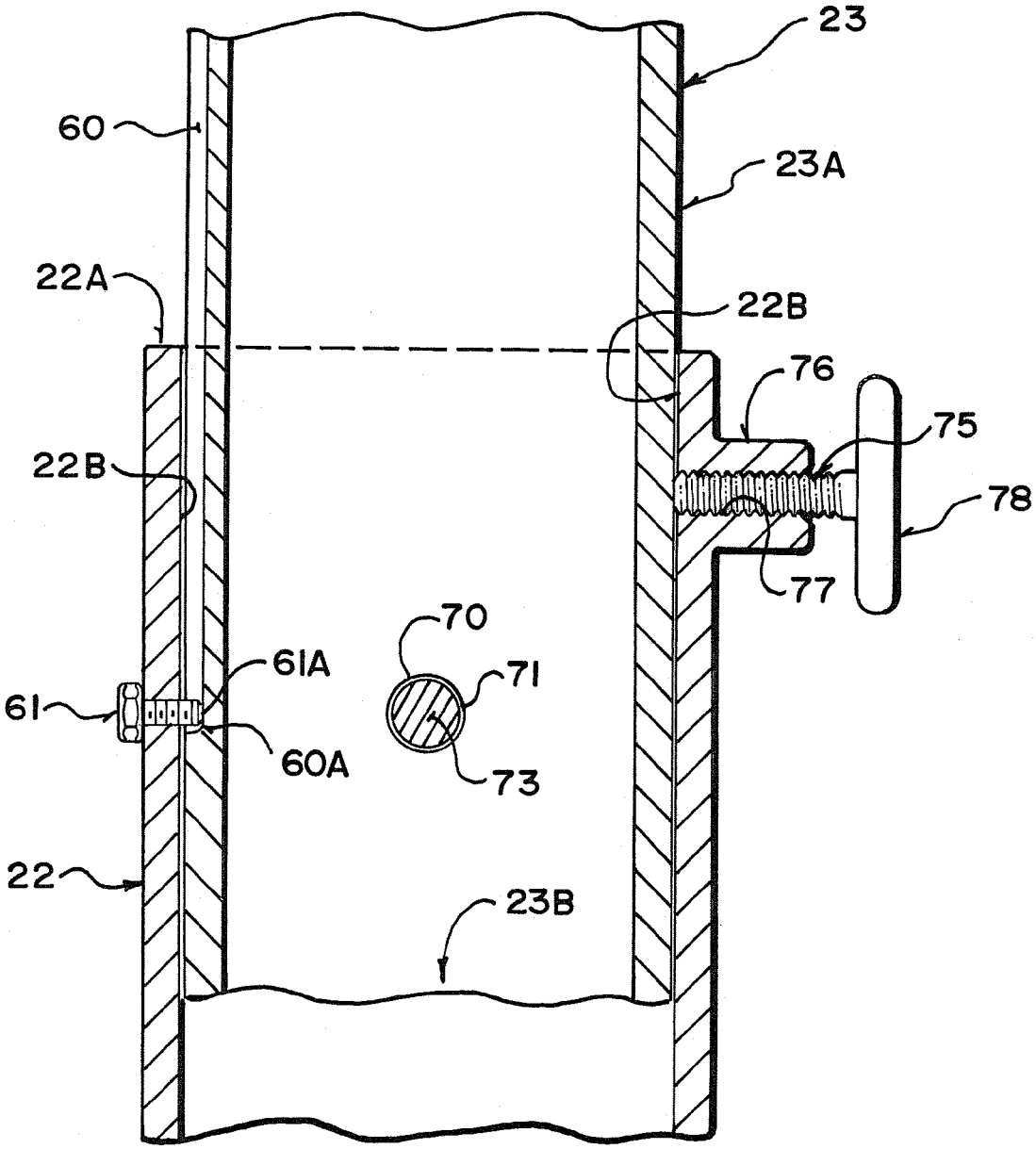
FIG. 5 is a cross sectional view along the lines 5-5 of FIG. 1.

As best shown in FIG. 5, the set screw 61 has a head 61A projecting through the inside surface 22A of the tubular portion 22. The head 61A thus extends into the groove 60 sufficiently to ensure that the tubular portion 23 can only move relative to the tubular portion 22 to an extent controlled and guided by the groove 60.

When moved to the extended position, the head 61A is located at the bottom 60A of the groove 60. In this position a hole 70 in the tubular portion 23 is aligned with a hole 71 in the tubular portion 22 allowing the passage therethrough of a locking pin 73. The pin passes through the hole of the tubular portions so as to extend through aligned opposed holes in both of the tubular portions so that ends of the pins project outwardly beyond both sides of the tubular portions. The pin can be locked in place by suitable locking members (not shown). In order to prevent or limit side to side movement of the tubular portion 23 and the tubular portion 22, a clamping screw 75 is provided mounted in a collar 76 so that a threaded shaft 77 of the screw passes through the wall of the tubular portion 22 and through the inside surface 22A thereof into engagement with an outside surface 23A of the tubular portion 23. Thus the clamping screw operable by a hand wheel 78 presses the tubular portion 23 away from the clamping screw toward the opposite side of the tubular portion 22 to hold in rigidly in place.

The groove 60 has the lower end thereof 60A spaced away from the bottom end 23B of the tubular portion 23. Also the upper end 60B of the groove is spaced away from the upper end of the tubular portion 23. In this way the groove 60 confines the movement of the tubular portion 23 to the required movement between the retracted and extended positions and prevents the tubular portion 23 from moving too far into the tubular portion 22 and also being extracted out of the tubular portion 22.

In particular the insertion of the locking pin 73 can be effected readily and quickly simply by pulling the tubular portion 23 up to its full extent defined by the groove 60 whereupon the pin can be readily inserted through the aligned holes 70 and 71.

The arrangement of the groove 63 in the portion 22 and its cooperation with a symmetrical set screw 64 and a symmetrical clamping screw 79 operates in exactly symmetrical manner with the exception that the groove 60, the set screw 64 and the clamping screw 79 are all arranged at 180 degree angular spacing relative to the symmetrical components of the connection between the tubular portion 23 and the tubular portion 22.

While the groove 60 is preferred since it avoids weakening the structure, the groove can be replaced by a slot which extends through the wall of the tubular portions 23 and 22.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. An apparatus for use in fall restraint anchoring comprising:

a base member for mounting at a location where workers require to be restrained against falling;

a post having a bottom mounting for attachment to the base member such that the post is supported in upstanding arrangement from the base member at the location;

at least one attachment loop at an upper end of the post for connection to a fall restraint connection line of a worker;

the post comprising a plurality of coaxial cylindrical tubes, each of circular cross-section, including a outer tube and an insert tube mounted as a sliding fit inside the outer tube for sliding movement longitudinally thereof for movement from an extended operating position to a retracted position, either the outer tube or the insert tube being attached to the bottom mounting;

the outside surface of the insert tube having a groove formed longitudinally thereof extending only part way therealong so that the groove terminates at its upper end a position spaced from an upper end of the insert tube and so that the groove terminates at its lower end a position spaced from a lower end of the insert tube;

and the outer tube having a projecting element thereon at a position thereon which is fixed both angularly and axially relative thereto and which extends radially inwardly of the inside surface thereof so as to extend into the groove;

the groove and the projecting element being arranged and located so as to limit longitudinal movement of the insert tube relative to the outer tube so that the insert tube is limited to longitudinal movement only between said extended and retracted positions;

and the groove, being mounted on the inner tube, and the projecting element, being angularly fixed to the outer tube, preventing relative rotation of the outer tube and the insert tube at any point along the longitudinal movement thereof.

2. The apparatus according to claim 1 wherein the projecting element comprises a set screw.

3. The apparatus according to claim 1 wherein there is only a single groove and a single projecting element.

4. The apparatus according to claim 1 wherein the outer tube and the insert tube have holes therethrough arranged to be aligned in the extended position for receipt therethrough of a locking pin and wherein the groove and the projecting element are arranged so that the holes are property aligned for receipt of the pin when the projecting element reaches the end of the groove.

5. The apparatus according to claim 1 wherein there is provided a clamping screw mounted on the outer tube so as to move a clamping end thereof radially of the outer tube and operable to clamp against the outer surface of the insert tube.

6. The apparatus according to claim 1 wherein the damping screw is arranged on the outer tube at a position spaced 180 degrees angularly from the projecting element.

7. The apparatus according to claim 1 wherein the post includes a plurality of attachment loops at axially spaced positions on the post each arranged for rotation around the post about the axis of the post.

8. The apparatus according to claim 1 wherein there is provided a separate extension piece arranged to be mounted on an upper end of the post and extending upwardly therefrom and including a further attachment loop at its upper end.

9. The apparatus according to claim 1 wherein there is provided a second insert tube mounted as a sliding fit inside the insert tube for sliding movement longitudinally thereof for movement from an extended operating position to a retracted position; the outside surface of the second insert tube having a second groove formed longitudinally thereof extending only part way therealong so that the second groove terminates at its upper end a position spaced from an upper end of the second insert tube and so that the second groove terminates at its lower end a position spaced from a lower end of the second insert tube; and the insert tube having a second projecting element at a fixed position thereon extending radially inwardly of the inside surface thereof so as to extend into the second groove; the second groove and the second projecting element being arranged and located so as to limit movement of the second insert tube relative to the insert tube so that the tubes are prevented from relative rotational movement and so that the second insert tube is limited to movement only between said extended and retracted positions.

10. The apparatus according to claim 9 wherein the second groove is arranged at 180 degree angular spacing from the groove.

11. The apparatus according to claim 1 wherein there is provided a jib portion comprising:

a collar surrounding the upper insert tube and mounted thereon as a sliding fit so as to be slidable longitudinally of the upper insert tube and rotatable around the upper insert tube about the axis of the post;

the collar having a bottom abutment surface resting upon a top edge of the lower outer tube a jib member mounted on the collar so as to extend outwardly from the collar to one side of the post;

the jib member being mounted on the collar for upward and downward pivotal movement about a horizontal axis;

and a tether member extending from the jib member to the attachment loop for supporting the jib member at an angle inclined upwardly and outwardly from the collar.

12. The apparatus according to claim 11 wherein the collar includes two semi-cylindrical collar parts connected by a hinge on one side of the post and clamped at abutment surfaces on an opposed side of the post.

13. The apparatus according to claim 11 wherein the jib member includes at least one bracket for supporting a winch and a pulley at an outer end thereof over which a cable from the winch is guided to pass.

14. The apparatus according to claim 11 wherein the post includes a bottom tube, an uppermost tube and at least one intermediate tube all of which are slidable each into the next and wherein the collar surrounds the uppermost tube with its abutment surface resting against an upper edge of the intermediate tube.

15. An apparatus for use in fall restraint anchoring comprising:

a base member for mounting at a location where workers require to be restrained against falling;

a post having a bottom mounting for attachment to the base member such that the post is supported in upstanding arrangement from the base member at the location;

at least one attachment loop at an upper end of the post for connection to a fall restraint connection line of a worker;

the post comprising a plurality of coaxial cylindrical tubes, each of circular cross-section, including a outer tube and an insert tube mounted as a sliding fit inside the outer tube for sliding movement longitudinally thereof for movement from an extended operating position to a retracted position, either the outer tube or the insert tube being attached to the bottom mounting;

the outside surface of the insert tube having a groove formed longitudinally thereof extending only part way therealong so that the groove terminates at its upper end a position spaced from an upper end of the insert tube and so that the groove terminates at its lower end a position spaced from a lower end of the insert tube;

and the outer tube having a single projecting element thereon at a position thereon which is fixed both angularly and axially relative thereto and which extends radially inwardly of the inside surface thereof so as to extend into the groove;

the groove and the single projecting element being arranged and located so as to limit longitudinal movement of the insert tube relative to the outer tube so that the single projecting element is located at the upper end of the groove in the retracted position and is located at the lower end of the groove in the extended position such that the insert tube is limited to longitudinal movement only between said extended and retracted positions;

and the groove, being mounted on the inner tube, and the projecting element, being angularly fixed to the outer tube, preventing relative rotation of the outer tube and the insert tube at any point along the longitudinal movement thereof.

16. An apparatus for use in fall restraint anchoring comprising:

a base member for mounting at a location where workers require to be restrained against falling;

a post having a bottom mounting for attachment to the base member such that the post is supported in upstanding arrangement from the base member at the location;

at least one attachment loop at an upper end of the post for connection to a fall restraint connection line of a worker;

the post comprising a plurality of coaxial cylindrical tubes, each of circular cross-section, including a outer tube and an insert tube mounted as a sliding fit inside the outer tube for sliding movement longitudinally thereof for movement from an extended operating position to a refracted position, either the outer tube or the insert tube being attached to the bottom mounting;

the outside surface of the insert tube having a groove formed longitudinally thereof extending only part way therealong so that the groove terminates at its upper end a position spaced from an upper end of the insert tube and so that the groove terminates at its lower end a position spaced from a lower end of the insert tube;

and the outer tube having a projecting element at a fixed position thereon extending radially inwardly of the inside surface thereof so as to extend into the groove;

the groove and the projecting element being arranged and located so as to limit movement of the insert tube relative to the outer tube so that the insert tube is limited to movement only between said extended and retracted positions:

and a locking pin separate from the projecting element;

the outer tube and the insert tube each having a locking hole for receiving the locking pin therethrough when the locking holes are axially and angularly aligned;

the locking hole in the insert tube being arranged relative to the groove in the insert tube and the locking hole in the outer tube being arranged relative to the projecting element in the outer tube such that the locking holes are aligned both axially and angularly by the location of the projecting element at the end of the groove.

* * * * *

UNITED STATES PATENT AND TRADEMARK OFFICE

CERTIFICATE OF CORRECTION

PATENT NO. : 7,537,085 B2
APPLICATION NO. : 10/407904
DATED : May 26, 2009
INVENTOR(S) : Jan Vetesnik It is certified that error appears in the above-identified patent and that said Letters Patent is hereby corrected as shown below:

IN THE SPECIFICATION:
Column 3, Line 16:
"failing" should read -- falling --.

IN THE CLAIMS:
Claim 6, Column 7, Line 8:
"damping" should read -- clamping --.

Claim 16, Column 8, Line 58:
"refracted" should read -- retracted --.

Signed and Sealed this

Twenty-fourth Day of August, 2010

David J. Kappos

David J. Kappos
*Director of the United States Patent and Trademark Office*